US007418983B2

(12) United States Patent
Mizuno et al.

(10) Patent No.: US 7,418,983 B2
(45) Date of Patent: Sep. 2, 2008

(54) BEVERAGE DISPENSER AND ALARM DEVICE FOR BEVERAGE DISPENSER

(75) Inventors: Yuji Mizuno, Ibaraki (JP); Katsumi Takenaka, Gyoda (JP)

(73) Assignee: Suntory Limited, Osaka (JP)

( * ) Notice: Subject to any disclaimer, the term of this patent is extended or adjusted under 35 U.S.C. 154(b) by 385 days.

(21) Appl. No.: 10/552,490

(22) PCT Filed: Feb. 25, 2005

(86) PCT No.: PCT/JP2005/003683

§ 371 (c)(1),
(2), (4) Date: Oct. 6, 2005

(87) PCT Pub. No.: WO2005/085121

PCT Pub. Date: Sep. 15, 2005

(65) Prior Publication Data

US 2006/0272736 A1 Dec. 7, 2006

(30) Foreign Application Priority Data

Mar. 5, 2004 (JP) ..... 2004-062249

(51) Int. Cl.
*B67C 3/02* (2006.01)
*B67C 3/00* (2006.01)

(52) U.S. Cl. ..... 141/94; 141/192; 141/237; 141/302

(58) Field of Classification Search ..... 141/94, 141/192, 237, 243
See application file for complete search history.

(56) References Cited

U.S. PATENT DOCUMENTS 2,718,630 A * 9/1955 Wait ..... 141/94
3,785,412 A * 1/1974 Stone ..... 141/94
5,074,341 A * 12/1991 Credle et al. ..... 141/94
5,349,993 A 9/1994 Casey (Continued)

FOREIGN PATENT DOCUMENTS

JP 9-50576 A 2/1997

(Continued)

OTHER PUBLICATIONS

Patent Abstracts of Japan, Publication No. 09050576 A, Publication Date: Feb. 18, 1997; in the name of Morita.

(Continued)

*Primary Examiner*—Timothy Lewis Maust
*Assistant Examiner*—Nicolas A Arnett
(74) *Attorney, Agent, or Firm*—Christie, Parker & Hale, LLP

(57) ABSTRACT

A beverage dispenser for ejecting a beverage into a receptacle, including a housing including a taking-in/out space, nozzles provided in the beverage dispenser for ejecting the beverage, obstacle detection module for detecting an obstacle around the nozzle, alarm generator for issuing an alarm when the detection module detects the obstacle, and a nozzle cover for covering the plurality of nozzles and the obstacle detection module to partially close the taking-in/out space. The alarm may not be issued from the alarm means when the beverage is ejected or a switch may be provided for causing the alarm generator inoperative. Thereby, those around the dispenser are informed of the fact that an operator has had unauthorized access to the nozzle in the beverage dispenser.

7 Claims, 3 Drawing Sheets

U.S. PATENT DOCUMENTS 5,884,807 A * 3/1999 Yun ..... 141/94
2001/0050116 A1 12/2001 Skell et al.

FOREIGN PATENT DOCUMENTS

JP 9-91528 A 4/1997
JP 2003-54697 A 2/2003
JP 2003-141627 A 5/2003

OTHER PUBLICATIONS

Patent Abstracts of Japan, Publication No. 09091528 A, Publication Date: Apr. 4, 1997; in the name of Inoue, et al.
Patent Abstracts of Japan, Publication No. 2003054697 A; Publicaton Date: Feb. 26, 2003; in the name of Iwata.
Patent Abstracts of Japan, Publication No. 203141627 A; Publication Date: May 16, 2003; in the name of Takahashi et al.

* cited by examiner

BEVERAGE DISPENSER AND ALARM DEVICE FOR BEVERAGE DISPENSER

CROSS-REFERENCE TO RELATED APPLICATION

This application is a National Phase Patent Application of International Application Number PCT/JP2005/003683, filed on Feb. 25, 2005, which claims priority of Japanese Patent Application Number 2004-062249, filed on Mar. 5, 2004.

BACKGROUND OF THE INVENTION

1. Field of the Invention

The present invention relates to a beverage dispenser, for ejecting a beverage from a nozzle under a user's control, and to an alarm device for the beverage dispenser.

2. Description of the Related Art

A beverage dispenser installed in a restaurant or the like ejects desired beverage stored in the dispenser into a receptacle such as a cup by operating a button or a lever provided on a front surface of the dispenser. Recently, beverage bars have been installed in particular restaurants and beverage dispensers are installed in such beverage bars. In the beverage bars, not only employees but also customers are allowed to operate the beverage dispenser to eject a desired amount of a desired beverage into the receptacle.

In this regard, when a general customer operates the beverage dispenser, there is a risk in that a finger tip of a customer unskilled in the operation may touch the nozzle of the beverage dispenser. In such a case, not only the next user of the beverage dispenser feels discomfort but also various bacteria may enter the interior of the beverage dispenser to cause the beverage dispenser itself to become unsanitary.

To avoid such a problem, in Japanese Unexamined Patent Publication (Kokai) No. 2003-54697, a beverage dispenser is proposed wherein, once the operator places a receptacle at a predetermined position, a conveyor device transfers the receptacle to another position at which the receptacle is inaccessible to the operator and, after the beverage is fed to the receptacle at the latter position, the receptacle is returned back to the original position. Further, in this Japanese Unexamined Patent Publication (Kokai) No. 2003-54697, as a door capable of being closed after the receptacle has been transferred to the inaccessible position is provided, it is possible to prevent an operator's finger tip from touching the nozzle or others.

However, in view of the recent world situation, the possibility is not negligible in that a man of evil intention may set a toxic material or something unusual in the nozzle of the beverage dispenser. In the beverage dispenser disclosed in the Japanese Unexamined Patent Publication (Kokai) No. 2003-54697, it could be thought that such a man of evil intention intentionally breaks part of the door, through which he has access from outside of the beverage dispenser to the nozzle within the interior of the beverage dispenser. In such a case, it might be supposed that if the distance between the position at which the receptacle is placed and the inaccessible position is longer than a length of a human arm, it is possible to prevent the man of evil intention from having access to the nozzle. Even in such a case, the man of evil intention may have access to the nozzle if an long tool is used. Once the man of evil intention has access to the nozzle of the beverage dispenser and set the toxic material or something unusual, other users or a person in charge of the beverage dispenser cannot recognize the fact until a problem has occurred.

Also, as the beverage dispenser disclosed in the Japanese Unexamined Patent Publication (Kokai) No. 2003-54697 must transfer the receptacle between the position at which the cup is initially placed and the inaccessible position, a size of the beverage dispenser becomes large as a whole, as well as conveyor means is separately required, and the beverage dispenser is complicated in structure to increase the manufacturing cost thereof.

Accordingly, the present inventors have diligently studied to overcome the above-mentioned problems in the prior art and obtained the conclusion that it is possible to solve the problems by issuing an alarm when an obstacle approaches the nozzle. Based on this conclusion, the present invention has been completed by providing a beverage dispenser satisfying the above function.

Thus, an object of the present invention is to provide a beverage dispenser capable of informing those around the dispenser of the access by an operator, and particularly a man of evil intention, to a nozzle in the interior of the beverage dispenser.

SUMMARY OF THE INVENTION

To achieve the above-mentioned object, according to a first aspect of the present invention, a beverage dispenser is provided, for ejecting a beverage into a receptacle, comprising nozzles provided in the beverage dispenser for ejecting the beverage, detection means for detecting an obstacle around the nozzle and alarm means for issuing an alarm when the detection means detects the obstacle.

That is, in the first and seventh aspects, if an finger tip of an operator, such as a customer unskilled in the operation, carelessly has access to the nozzle of the beverage dispenser, or a man of evil intention intentionally has access to the nozzle, the detection means detects such a fact and the alarm means issues an alarm. Thus, those around the dispenser are informed that something unusual has had access to the nozzle, which also indirectly prevents the operator from having access to the nozzle. Further, according to the first and seventh aspects, as the alarm once issued continues even after the man having access to the nozzle has left, it is possible to notify another operator using the dispenser at a later time. In this regard, the alarm means may be an acoustic generator and/or a light emitter.

According to a second aspect, a beverage dispenser is provided, as defined by the first aspect, having a mechanism capable of not detecting the receptacle, into which the beverage is ejected from the beverage dispenser, as an obstacle.

That is, according to the second aspect, as the detection means does not operate when the receptacle is put into or out from the beverage dispenser, the alarm is not issued, whereby the beverage dispenser is ordinarily usable by the operator.

According to a third aspect, a beverage dispenser as defined by the second aspect is provided, wherein the mechanism capable of not detecting the receptacle into which the beverage is ejected defines a detection area of the obstacle detection means in the vicinity of the nozzles.

According to a fourth aspect, a beverage dispenser as defined by any one of the first to the third aspect is provided, wherein the alarm is not issued from the alarm means when the beverage is ejected.

There is a possibility that the beverage itself (including drops of the residue remaining in the nozzle after the beverage has been ejected) is detected as an obstacle during the ejection thereof. In the fourth aspect, since the alarm means is inoperative when the beverage is ejected, the beverage dispenser is normally usable particularly when the operator takes the receptacle out from the dispenser. Also, a time in which the alarm means is inoperative is variable in accordance with kinds and/or amount of the beverage.

According to a fifth aspect, a beverage dispenser as defined by any one of the first to the fourth aspect is provided, further comprising a switch capable of making the alarm means inoperative.

That is, in the fifth aspect, in a particular case, for example, when the nozzle of the beverage dispenser is cleaned, the alarm means is made inoperative by the switch so that no alarm is issued.

According to a sixth aspect, a beverage dispenser as defined by any one of the first to the fifth aspect is provided, wherein the alarm means is an acoustic generator.

That is, in the sixth aspect, even if the next user or a person in charge of the beverage dispenser is working or in conversation with others, it is possible to immediately inform him of the occurrence of the problem through by sound.

The above-mentioned aspects have a common effect to inform those around the dispenser of a fact in that something unusual has had access to the nozzle of the beverage dispenser and to indirectly prevent the operator from gaining access thereto.

Further, according to the second aspect, another effect is provided in that the operator is able to normally use the beverage dispenser.

Further, according to the third aspect, another effect is provided in that the operator is able to use the beverage dispenser particularly when the receptacle is taken out.

Further, according to the fourth aspect, another effect is provided in that the operator is able to use the beverage dispenser particularly when the beverage is ejected.

Further, according to the fifth aspect, another effect is provided in that it is possible to make the alarm means inoperative when unnecessary.

Further, according to the sixth aspect, another effect is provided in that the problem is informed immediately after it has happened.

These and other objects, features and advantages of the present invention will be more apparent from the following detailed description of the preferred embodiments with reference to the attached drawings.

DETAILED DESCRIPTION OF THE PREFERRED EMBODIMENTS

Figure 1:
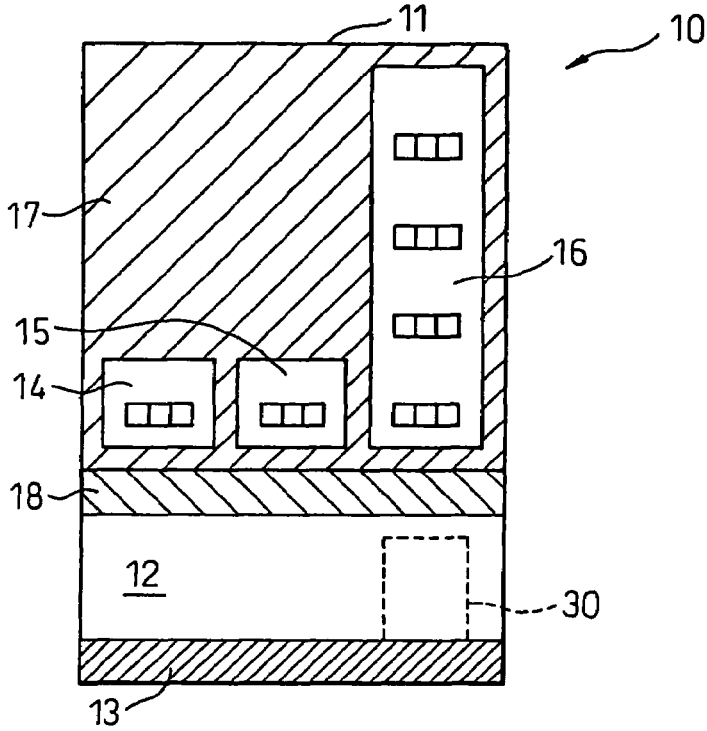
FIG. 1 is a front view of a beverage dispenser according to the present invention.

The embodiments of the present invention will be described below with reference to the attached drawings wherein the same reference numerals are used for denoting the same or similar elements. For the purpose of facilitating understanding, the scales of these drawings are properly changed.

FIG. 1 is a front view of the inventive beverage dispenser. As shown in FIG. 1, the beverage dispenser 10 is provided with a front door 17 for partially covering a front surface of a housing 11. As illustrated, there are selection button panels 14, 15 and 16 in the front door 17, and each of the selection button panels 14, 15 and 16 has a plurality of selection buttons for selecting kinds and/or amounts of beverages. In addition, a taking-in/out space 12, for a receptacle, opens in a lower part of the housing 11 while extending in the depth direction (i.e., the direction vertical to the paper surface). A receptacle stage 13 in which a receptacle 30, such as a paper cup is placed is provided at the lowermost end of the receptacle taking-in/out space 12. Further, a nozzle cover 18 is provided at the uppermost end of the taking-in/out space 12, whereby part of the interior of the taking-in/out space 12 is invisible from outside.

Figure 2:
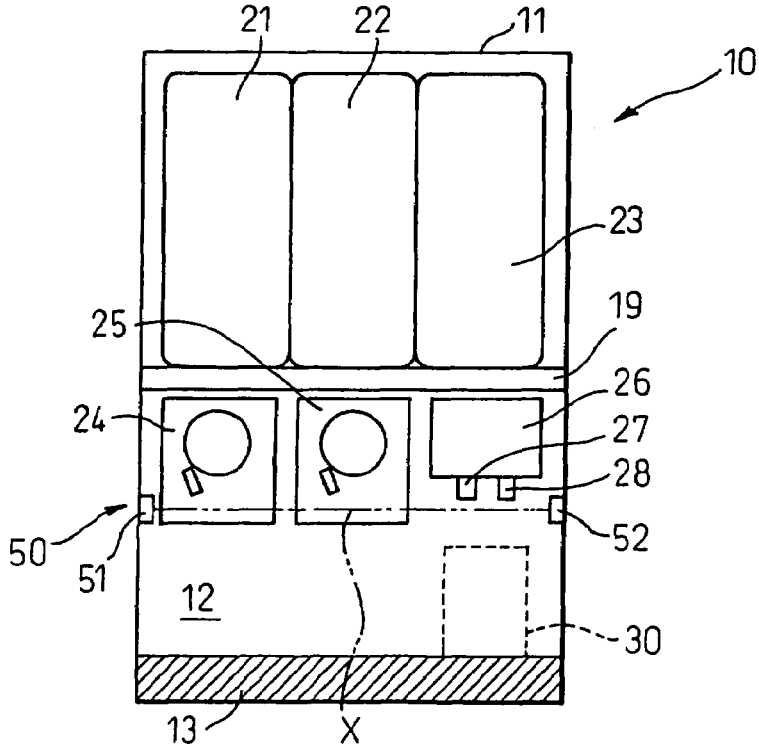
FIG. 2 is a front view of the inventive beverage dispenser from which a front door and a nozzle cover are removed.

FIG. 2 is a front view of the inventive beverage dispenser from which the front door 17 and the nozzle cover 18 are removed. As shown in FIG. 2, a plurality of, for example, three tanks 21, 22 and 23 are installed on a shelf 19 in the interior of the beverage dispenser 10. Each of these tanks 21, 22 and 23 is filled in advance with a different kind of syrup. Drink feeding sections 24, 25 and 26 are disposed below the shelf 19 at positions corresponding to the respective tanks 21, 22 and 23. The beverage feeding sections 24, 25 and 26 are provided with piping (not shown) for connecting them to the tanks 21, 22 and 23, respectively, piping (not shown) for feeding cold water and piping (not shown) for feeding soda water so that the respective syrup in the tank 21, 22 or 23 is ejected from the respective nozzle of the beverage feeding section 24, 25 or 26 after being diluted with the cold water or soda water. Solenoid valves (not shown) for opening and closing the respective nozzles (not shown) in the beverage feeding sections 24, 25 and 26 are connected to the selection buttons in the selection button panels 14 and 15 shown in FIG. 1. On the other hand, as shown in FIG. 2, the beverage feeding section 26 includes two nozzles 27 and 28, and the solenoid valves thereof are respectively connected to the selection buttons in the selection button panel 16.

As shown in FIG. 2, there is obstacle detection means 50 for detecting an obstacle on the lateral side of the receptacle taken-in/out space 12. The obstacle detection means 50 according to the present invention is an obstacle detection sensor including a light emitter 51 provided on the left side in the interior of the receptacle taking-in/out space 12 and a light receiver 52 provided on the right side in the interior of the receptacle taking-in/out space 12 at a position corresponding to the light emitter 51. As is apparent from FIG. 2, a line X connecting the light emitter 51 and the light receiver 52 to each other is positioned beneath the nozzles 27 and 28 of the beverage feeding section 26 and those, not shown, of the beverage feeding sections 24 and 25. The light emitter 51 and the light receiver 52 of the obstacle detection means 50 are normally covered with the nozzle cover 18 of the beverage dispenser 10 to be invisible by the operator (see FIG. 1). In this regard, in FIG. 2, the lower ends of the light emitter 51 and the light receiver 52 of the obstacle detection means 50 are located at positions corresponding to the lower end of the nozzle cover 18. Accordingly, as the nozzle cover 18 interferes with the access of the receptacle 30, such as a paper cup to the obstacle detection means 50, no reaction occurs in the obstacle detection means 50 when merely taking the receptacle into or out from the receptacle taking-in/out space 12 by the operator. On the other hand, if the operator inserts his hand into the receptacle taking-in/out space 12 and bends his fingers upward so as to exceed the line X to be closer to the nozzles 27 and 28, the obstacle detection means 50 operates.

Figure 3:
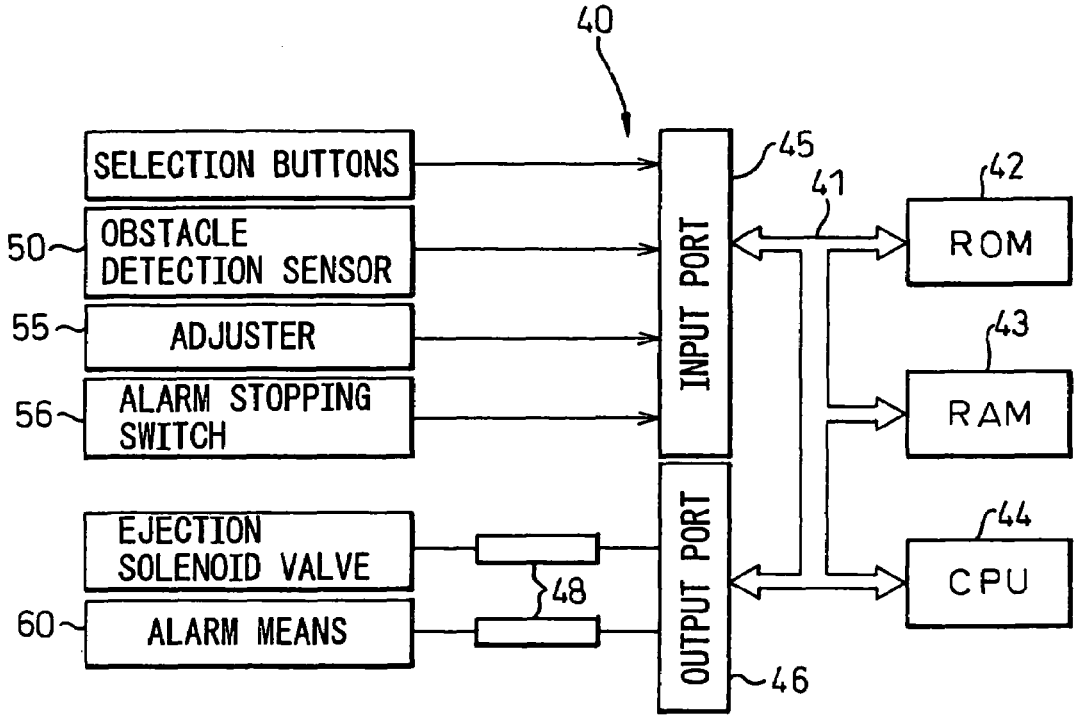
FIG. 3 illustrates a system for controlling the inventive beverage dispenser.

FIG. 3 illustrates a control system for the inventive beverage dispenser. The control system 40 shown in FIG. 3 may be either incorporated into the housing 11 of the beverage dispenser 10 or connected to the exterior of the beverage dispenser 10. As shown in FIG. 3, the control system 40 consists of a microcomputer including a ROM (read-only memory) 42, a RAM (random access memory) 43, a CPU (microprocessor) 44, an input port 45 and an output port 46 which are connected to each other through a two-way bus 41. An operational program 100 or others described later is stored in the ROM 42. Also, times measured by a timer, not shown, and/or general data necessary for operating the beverage dispenser are stored in the RAM 43. Output signals from the respective selection buttons in the selection button panels 14, 15 and 16 shown in FIG. 1 are input into the corresponding input port 45. Also, output signals from the obstacle detection sensor 50 shown in FIG. 2 are input into the corresponding input port 45. Similarly, output signals from an adjuster 55 for varying an output from an alarm means 60 (not shown in FIG. 1 or others) and output signals from an alarm stopping switch 56 (not shown in FIG. 1 or others) are also input to the input port 45. On the other hand, the output port 46 is connected with ejection solenoid valves (not shown) corresponding to the respective nozzles of the beverage feeding sections 24, 25 and 26 and with the alarm means 60 via the corresponding drive circuits 48.

The alarm means 60 for the inventive beverage dispenser 10 is an acoustic generator such as a buzzer provided on the lateral side of the beverage dispenser 10. In this regard, the alarm means 60 may be any of means capable of informing those around the dispenser of a fact that the obstacle has gained access to the nozzles 27 and 28 etc. For example, the alarm means 60 may be a light emitter or the combination of an acoustic generator and a light emitter.

Figure 4:
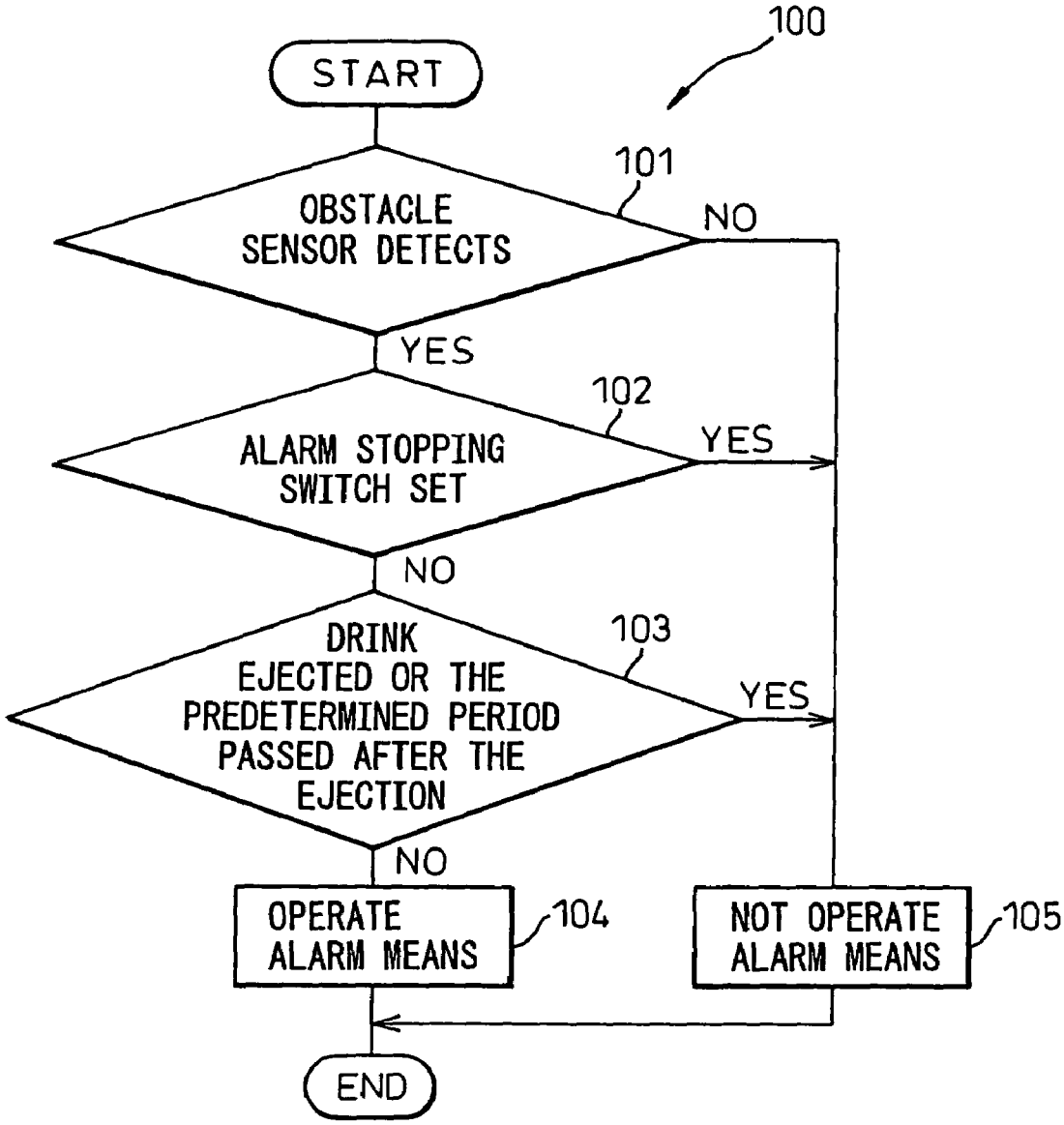
FIG. 4 is a flow chart illustrating the operation of the inventive beverage dispenser.

FIG. 4 is a flow chart illustrating an operational program 100 for the inventive beverage dispenser, and the operation of the inventive beverage dispenser 10 will be described with reference to FIG. 4. The operational program 100 processed by the control system 40 is continuously repeated unless an electric power source for the beverage dispenser 10 is switched off.

At step 101 of the operational program 100 shown in FIG. 4, it is determined whether or not the obstacle detection means 50 detects the obstacle; that is, whether or not a human hand has access to the nozzle 27 or 28 etc. in the beverage feeding section 26. If obstacles are not detected the routine proceeds to step 105 to not operate the alarm means. On the contrary, if the obstacle detection means 50 detects the obstacle, the routine proceeds to step 102. At step 102, it is determined whether or not the alarm-stopping switch 56 shown in FIG. 3 is set.

If the alarm-stopping switch 56 is set at step 102, the routine proceeds to step 105 not to operate the alarm means 60. Thereby, it is possible to prevent the alarm means 60 from operating when the issuing of an alarm is unnecessary, for example, when it is necessary to clean the nozzles of the beverage feeding sections 24, 25 and 26 in the beverage dispenser 10. On the other hand, if the alarm-stopping switch 56 is reset, the routine proceeds to step 103.

At step 103, it is determined whether or not the present time is during the beverage ejecting or the present time is within a predetermined period after the completion of the ejection of the beverage. When one of the selection buttons is pushed, the solenoid valve corresponding to this selection button is opened to eject the corresponding beverage therefrom. As the beverage intersects the line X shown in FIG. 2 when the beverage is ejected from the nozzle in the beverage feeding section 24, 25 or 26, this beverage is detected by the obstacle detection means 50. In such a case, it is unnecessary to operate the alarm means 60 because no human hand or others has approached the nozzle 27 or 28 but only the beverage is detected. Accordingly, the routine proceeds to step 105 to cause the alarm means 60 inoperative.

In this regard, even if solenoid valve of the nozzle from which the beverage is ejected has been closed to complete the ejection of the beverage, the beverage remaining in the interior of the nozzle drips for a predetermined period from the completion of the ejection, which may be detected as the obstacle by the obstacle detection means 50. Accordingly, a time from the completion of the ejection is measured by a timer (not shown) provided in the beverage dispenser 10, and at step 103, it is determined at the same time whether or not the time passage is within a predetermined period; that is, the time passage is shorter than the predetermined period. The predetermined period used at step 103 is sufficient for the dripping of the beverage to stop after completing the ejection thereof. The predetermined period is different in accordance with kinds and/or amounts of the beverage. These periods are previously stored in the RAM 43 of the control system 40 as a function of the kinds and the amounts of the beverage. At step 103, if it is determined that the time passage after the completion of the ejection is within the predetermined period; i.e., if the time passage is shorter than the predetermined period, it is unnecessary to operate the alarm means 60 because this only means that the obstacle detection means 50 detects the dripping of the beverage. Accordingly, in such a case, the routine proceeds to step 105 to cause the alarm means 60 to be inoperative.

On the other hand, if the time passage after the completion of the ejection is not within the predetermined period at step 103, it is determined that the object detected by the obstacle detection means 50 is a hand of the unskilled operator or the man of evil intention or the like. Thus, the routine proceeds to step 104 at which the alarm is issued by the alarm means 60. Thereby, it is possible to inform those around the beverage dispenser 10 of an abnormality therein. When the alarm is issued, the operator or the man of evil intention whose hand is detected by the obstacle detection means 50 may withdraw his hand on the way to the nozzle, whereby he is indirectly prevented from having access to the nozzle. As a result, it is possible to avoid the contamination of the beverage dispenser 10 due to the contact of the human hand with the nozzle. Such an issue of an alarm by the alarm means 60 is particularly effective when the man of evil intention is intended to set a toxic material or something unusual in the nozzle.

The alarm continues once it has been issued because there is a possibility in that a hand of the man of evil intention may approach the nozzles 27 and 28. In such a case, it is impossible to stop the alarm so far as the alarm-stopping switch 56 does not release the alarm. Accordingly, even after the above-mentioned man has retreated from the beverage dispenser 10, the alarm continues to inform other operators who wish to use the dispenser at a later time of the occurrence of abnormality in the beverage dispenser 10, such that something unusual or the like may be set in the nozzle.

In this regard, as described before, the alarm means 60 is connected to the adjuster 55 via the control system 40. Accordingly, the sound volume of the alarm is adjustable by operating the adjuster 55 if the alarm means 60 is the acoustic generator. Thereby, if the beverage dispenser 10 is installed in a relatively large place or a person in charge of the beverage dispenser 10 is relatively far therefrom, the sound volume may be larger. On the contrary, if the beverage dispenser 10 is installed in a relatively small place or a person in charge of the beverage dispenser 10 is relatively close thereto, it is possible to reduce the sound volume. In such a way, according to the present invention, it is possible to optimize the sound volume of the beverage dispenser 10.

While the beverage is ejected from the beverage dispenser 10 shown in FIG. 1 by operating the selection button, it is apparent that the present invention is applicable to a dispenser of a type wherein a beverage is ejected by directly operating a cock functioned as a switching valve. In the present specification, the term "beverage" includes a drinking water, such as mineral water.

The present invention has been described above with reference to the typical embodiment. It will be understood by those with an ordinary skill in the art that the above-mentioned and other changes, modifications, eliminations and/or additions are possible without departing from the scope and spirit of the present invention.

What is claimed is:

1. A beverage dispenser for ejecting a beverage into a receptacle comprising;

a housing including a taking-in/out space;

a plurality of nozzles provided above the taking-in/out space for ejecting the beverage into the receptacle;

obstacle detection means for detecting an obstacle around the plurality of nozzles;

alarm means for issuing an alarm when the detection means detects the obstacle; and a nozzle cover for covering the plurality of nozzles and the obstacle detection means to partially close the taking-in/out space.

2. A beverage dispenser as defined by claim 1, wherein the obstacle detection means is configured to not detect the receptacle as the obstacle.

3. A beverage dispenser as defined by claim 2, wherein the obstacle detection means is configured to include a detection area in the vicinity of the nozzles.

4. A beverage dispenser as defined by any one of claims 1 to 3, wherein no alarm is issued from the alarm means when the beverage is ejected.

5. A beverage dispenser as defined by claim 1, further comprising a switch capable of making the alarm means inoperative.

6. A beverage dispenser as defined by claim 1, wherein the alarm means is an acoustic generator.

7. A beverage dispenser as defined by claim 1, wherein the obstacle detection means is located between the plurality of nozzles and the receptacle to be placed in the taking-in/out space.

* * * * *

UNITED STATES PATENT AND TRADEMARK OFFICE

CERTIFICATE OF CORRECTION

PATENT NO. : 7,418,983 B2
APPLICATION NO. : 10/552490
DATED : September 2, 2008
INVENTOR(S) : Yuji Mizuno It is certified that error appears in the above-identified patent and that said Letters Patent is hereby corrected as shown below:

In the Claims

| | |
|---|---|
| Column 7, line 16, Claim 1 | Delete “;”,<br>Insert --:-- |

Signed and Sealed this

Twenty-first Day of April, 2009

JOHN DOLL
*Acting Director of the United States Patent and Trademark Office*